US005428373A

United States Patent [19]

Shiraishi et al.

[11] Patent Number: 5,428,373

[45] Date of Patent: Jun. 27, 1995

[54] THERMAL HEAD FOR THERMAL RECORDING OR THERMAL TRANSFER RECORDING AND METHOD OF MANUFACTURING THE SAME

[75] Inventors: Masashi Shiraishi, Chiba; Masahiro Nakano, Saitama; Satoshi Motegi, Chiba; Kyouichi Takahashi, Chiba; Kouzou Maehara, Chiba, all of Japan

[73] Assignee: TDK Corporation, Tokyo, Japan

[21] Appl. No.: 981,013

[22] Filed: Nov. 24, 1992

[30] Foreign Application Priority Data

| | | | |
|---|---|---|---|
| Nov. 26, 1991 | [JP] | Japan | 3-336051 |
| Mar. 9, 1992 | [JP] | Japan | 4-086398 |
| Aug. 11, 1992 | [JP] | Japan | 4-235407 |
| Aug. 25, 1992 | [JP] | Japan | 4-225709 |

[51] Int. Cl.[6] ..... B41J 2/335

[52] U.S. Cl. ..... 347/203; 29/611

[58] Field of Search ..... 346/76 PH; 29/611

[56] References Cited

U.S. PATENT DOCUMENTS

| | | | |
|---|---|---|---|
| 4,571,598 | 2/1986 | Shinozaki et al. | 346/76 PH |
| 4,680,593 | 7/1987 | Takeno et al. | 346/76 |
| 4,750,260 | 6/1988 | Takeno et al. | 29/611 |
| 4,764,659 | 8/1988 | Minami et al. | 219/216 |
| 4,835,548 | 5/1989 | Nikadio et al. | 346/76 PH |
| 4,862,193 | 8/1989 | Hattori et al. | 346/76 PH |

FOREIGN PATENT DOCUMENTS

| | | |
|---|---|---|
| 55-103981 | 8/1980 | Japan . |
| 57-83476 | 5/1982 | Japan . |
| 59-79774 | 5/1984 | Japan . |
| 59-146871 | 8/1984 | Japan . |
| 59-159365 | 9/1984 | Japan . |
| 60242073 | 12/1985 | Japan . |
| 62-9965 | 1/1987 | Japan . |
| 62028260 | 2/1987 | Japan . |
| 62270347 | 11/1987 | Japan . |
| 63118272 | 5/1988 | Japan . |
| 63158582 | 7/1988 | Japan . |
| 63191655 | 8/1988 | Japan . |

*Primary Examiner*—Haran H. Tran

*Attorney, Agent, or Firm*—Martin Novack

[57] ABSTRACT

A thermal head for thermal recording or thermal transfer recording and a method of manufacturing the head. The head has a heat sink having an upper surface, a heating element substrate, disposed on the upper surface of the heat sink, having a projected convex portion on which an array of heating resistor elements are arranged, an electrical structure mounted on the same side as that of the upper surface of the heat sink and electrically connected to the heating resistor elements, and a protection structure for mechanically protecting the electrical structure. The substrate is constituted such that the height of the substrate from the surface of the heat sink is higher than the height of the protection structure, and the height of the projected convex portion is equal to or more than 0.6 mm.

38 Claims, 7 Drawing Sheets

THERMAL HEAD FOR THERMAL RECORDING OR THERMAL TRANSFER RECORDING AND METHOD OF MANUFACTURING THE SAME

BACKGROUND OF THE INVENTION

1. Field of the Invention

The present invention relates to a thermal head for thermal recording or thermal transfer recording and to a method of manufacturing the thermal head. More particularly, the present invention relates to a thermal head which is preferably utilized in a printer of a ticket vending machine, a printer for prepaid cards, a bar code printer, a printer for video signals, a transfer color printer, or a label printer.

2. Description of the Related Art

There are two typical types of thermal head utilized for thermal recording or thermal transfer recording. One is a plane type thermal head, and the other is an end face type thermal head.

The plane type thermal head is generally constituted by mounting an alumina substrate on which both an array of heating resistor elements and an IC chip for driving these heating resistor elements are formed, and a printed circuit board for electrically connecting the drive IC with an external circuit, on a plane surface of a heat sink formed by an aluminum plate.

The drive IC chip and bonding wires for connecting the IC with the heating resistor elements may be covered by protection resin. Over the resin, a cover fixed to the heat sink for securing the protection of the electrical connection between the IC and the printed circuit board is provided.

However, such the conventional plane type thermal head is difficult to be used for printing against a hard sheet such as a card (ex. cardboard, plastic card, metal card, etc.) because the card will be abutted to the cover which is projected over the IC and thus feeding of the card will be blocked. Also, such the thermal head has a problem that it is difficult to make it small in size. The latter is because that even if it is used for printing against ordinal flexible paper, the cover should be located apart from the heating element array so that a platen roller for pressing the paper to the heating element array does not touch the cover. Therefore, the substrate of the thermal head will become large in size. If the size of the head substrate is large, only a few number of the substrates can be processed in one sputtering process, carried out in a chamber, for forming a thin-film layer on the head substrate. As a result, the manufacturing cost of each thermal head will increase.

In each of publications of Japanese Patent Application Laid Open Nos. 57(1982)-83476, 59(1984)-146871, and 59(1984)-159365, a thermal head having a convex heating element array on a substrate to improve heat conductivity to a heat sensitive paper is described. However, since the projecting height of such the convex heating element arrays from the respective substrates are in the order of several tens $\mu$m or less, there also exists a problem that feeding of the paper or hard sheet is blocked by a component such as a cover, mounted on the substrate.

In a publication of Japanese Utility Model Application Laid Open No. 58(1983)-60458, a thermal head having a convex heating element array the projecting height of which is higher than that of an drive IC is described. However, as the projecting height of this convex heating element array is about 0.5 mm or less, the above-mentioned problem of feeding is also occurred when a cover is attached over the drive IC. Furthermore, since both of side surfaces of this convex heating element array are formed to rise nearly perpendicularly from the substrate surface, conductive layer formed on these side surfaces by evaporation or etching process will become thin in thickness causing the conductive patterns to break off or to increase in resistance.

The end face type thermal head is one provided with a heating element array mounted on the end face of its heat sink. There are two types of end face type thermal heads, namely an L-shaped end face type thermal head and a curved end face type thermal head.

The L-shaped thermal head is generally constituted by mounting, on the end surface of a heat sink, an alumina substrate on which an array of heating resistor elements is formed, mounting a printed circuit board on the side plane surface of the heat sink, and electrically connecting between the circuit pattern in the alumina substrate and the circuit pattern in the printed circuit board by a TAB tape (film carrier) on which an IC chip for driving the heating resistor elements is mounted. The printed circuit board electrically connects the drive IC with an external circuit.

In such the L-shaped thermal head, a cover fixed to the heat sink should also be provided to cover over a junction between the circuit pattern of the alumina substrate and the film carrier on which the drive IC chip is mounted, for protecting the electrical connection. This cover causes, as similar to that in the plane type thermal head, feeding of a hard sheet to be printed such as a card to be blocked.

The curved end face type thermal head is substantially constituted by mounting, on the end of a heat sink made of aluminum for example, an alumina substrate provided with a curved end surface on which an array of heating resistor elements is formed, and on the side plane surface of which an IC chip for driving the heating resistor elements is mounted. The heating elements and the drive IC are electrically connected by bonding wires. A printed circuit board for electrically connecting the drive IC with an external circuit is mounted on the side surface of the heat sink, in the same side as that of the IC chip. Such the thermal head is known by publications of Japanese Patent Application Laid Open Nos. 55(1980)-103981, and 62(1987)-9965.

According to such the curved end face type thermal head, feeding of paper or hard sheet will be smooth without being blocked by any component mounted on the substrate. However, since it is necessary to form thin film layers on both the curved end surface and side surfaces, the manufacturing of the head is very complicated and thus takes a great deal of cost. Furthermore, according to such the curved end face type thermal head, since heat from the heating elements will be transmitted along the longitudinal direction of the head and thus the heat conduction pass in the aluminum substrate will be narrow in sectional area and long in distance, effective radiation of heat cannot be expected causing the thermal head to be easily excessive heat accumulation.

SUMMARY OF THE INVENTION

It is therefore an object of the present invention to provide a thermal head and a method of easily manufacturing the thermal head, which head can smoothly print against a hard sheet such as a card.

Another object of the present invention is to provide a thermal head which has a good heat radiation characteristics in addition to the above-mentioned object.

Further object of the present invention is to provide a thermal head which can smoothly print against a hard sheet and also can prevent conductive patterns thereof from breaking off.

Still further object of the present invention is to provide a thermal head and a method of manufacturing the thermal head, which head can be manufactured in low cost, and furthermore can be used with a large size platen roller.

Further object of the present invention is to provide a thermal head which has effective heat radiation characteristics better than that of the curved end face type thermal head.

According to the present invention, a thermal head for thermal recording or thermal transfer recording has a heat sink having an upper surface, a heating element substrate, disposed on the upper surface of the heat sink, having a projected convex portion on which an array of heating resistor elements are arranged, an electrical structure mounted on the same side as that of the upper surface of the heat sink and electrically connected to the heating resistor elements, and a protection structure for mechanically protecting the electrical structure. The substrate is constituted that height of the substrate from the surface of the heat sink is higher than height of the electrical structure and protection structure, and height of the projected convex portion is equal to or more than 0.6 mm.

As a result, feeding of a hard sheet to be printed such as a card will not be blocked by these structures and thus printing can be smoothly performed even against the hard sheet. Also, since the head closely contacts with a paper or the card to be printed, high quality printing can be expected.

Preferably, the heating element substrate is constituted that a raising angle of at least one side surface of the projected convex portion is equal to or more than 20 degrees.

Thus, the substrate having a width smaller than that of a typical substrate can be obtained in spite of keeping a necessary height. The smaller the substrate in size, the more substrates being formed from one ceramic sheet resulting effective manufacturing of the head.

Also preferably, the heating element substrate is constituted that the raising angle of at least one side surface is equal to or less than 70 degrees.

Thus, no break off of conductive patterns formed on the substrate and precise patterning of the conductive patterns can be expected.

It is preferable that the head further has an electrical connection substrate (printed circuit board), disposed on the upper surface of the heat sink, for electrically connecting the electrical structure with an external circuit. The electrical structure may be mounted on the electrical connection substrate or on the heating element substrate mounted on the upper surface of the heat sink.

The electrical structure may include an IC for driving the heating resistor elements. The IC may be electrically connected to the heating resistor elements and to the electrical connection substrate by wire bonding or by flip chip bonding.

In a modified case, the thermal head may have a film carrier, one end of which is disposed on the upper surface of the heat sink and the other end of which is disposed on a side surface of the heat sink, for electrically connecting the electrical structure with an external circuit. The electrical structure may be mounted on the heating element substrate.

According to the end face type thermal head having such constitution, since all the bottom surface of the heating element substrate contacts with the upper surface of the heat sink and thus heat conduction path is very short, heat from the heating elements will be easily transmitted to the heat sink. Thus, effective radiation of heat and therefore good printing without blot can be expected as well as the plane face type thermal head. The size of the end surface of the thermal head, used for printing can be designed in small causing the total size of the printer to be small, as well as the end face thermal head.

Also, since the heating element substrate can be formed small in size, effective manufacturing of the head can be also obtained. It is another advantages that the heating element substrate of this end face type thermal head can be manufactured by the same manufacturing line as that of the plane type thermal head.

The electrical structure may be an electrical junction of the heating resistor elements and the film carrier.

An IC for driving the heating resistor elements may be mounted on the film carrier.

The protection structure may include a protection resin of soft type or hard type for covering the electrical structure. The protection structure may also include a cover disposed over the protection resin.

In a modified case, the thermal head may have a flexible electrical connection substrate, one end of which is disposed on the upper surface of the heat sink and the other end of which is disposed on a side surface of the heat sink, for electrically connecting the electrical structure with an external circuit. The electrical structure may be mounted on the flexible electrical connection substrate.

The electrical structure may be an IC for driving the heating resistor elements.

The protection structure may include a protection resin of soft type or hard type for covering the electrical structure. The protection structure may also include a cover disposed over the protection resin.

Also, the protection structure may include a protection resin for covering the electrical structure and a cover disposed on and integrated with the protection resin. The cover is fixed to the electrical connection substrate by this protection resin.

One end of this cover may be abutted to the heating element substrate so that precise adjustment of the height of the cover itself can be easier.

Since the cover is adhered closely to the resin and thus the height of the resin is adjusted by the shape of the cover, the height of the cover and also of the resin can be kept low. Also, since the cover is fixed to the electrical connection substrate by using the resin as adhesive, no special parts such as screws for fixing the cover are required. Therefore, a process of fixing cover can be eliminated causing the manufacturing cost of the thermal head to decrease.

According to the present invention, a method of manufacturing a thermal head includes the steps of forming a heating element substrate having a projected convex portion on which an array of heating resistor elements are arranged, mounting the heating element substrate on an upper surface of a heat sink, mounting an electrical structure on the same side as that of the upper surface of the heat sink and electrically connecting the electrical structure to the heating resistor elements, and forming a protection structure for mechanically protecting the electrical structure so that height of the heating element substrate from the surface of the heat sink is higher than height of the protection structure, and that height of the projected convex portion is equal to or more than 0.6 mm.

The heating element substrate forming step may include a step of forming the heating element substrate so that a raising angle of at least one side surface of the projected convex portion is equal to or more than 20 degrees.

The heating element substrate forming step may include a step of forming the heating element substrate so that a raising angle of at least one side surface of the projected convex portion is equal to or less than 70 degrees.

The heating element substrate forming step may include steps of mechanically cutting a basic plate block to form a plurality of heating element substrates on the block and then burning the cut block.

The heating element substrate forming step may further include a step of forming a plurality of layers on the burned block by thin film forming processes.

Also, the heating element substrate forming step may include a step of separating the thin film formed block into a plurality of heating element substrates.

It is preferable that the method further includes steps of mounting an IC for driving the heating resistor elements on an electrical connection substrate by flip chip bonding, mounting the electrical connection substrate on the upper surface of the heat sink, and electrically connecting the IC with an external circuit.

The protection structure forming step preferably includes steps of forming a protection resin for covering the IC, and attaching a cover on the resin before the resin is hardened so that the cover is integral with the resin and fixed to the electrical connection substrate by means of the resin.

Further objects and advantages of the present invention will be apparent from the following description of the preferred embodiments of the invention as illustrated in the accompanying drawings.

DESCRIPTION OF THE PREFERRED EMBODIMENTS

Figure 1:
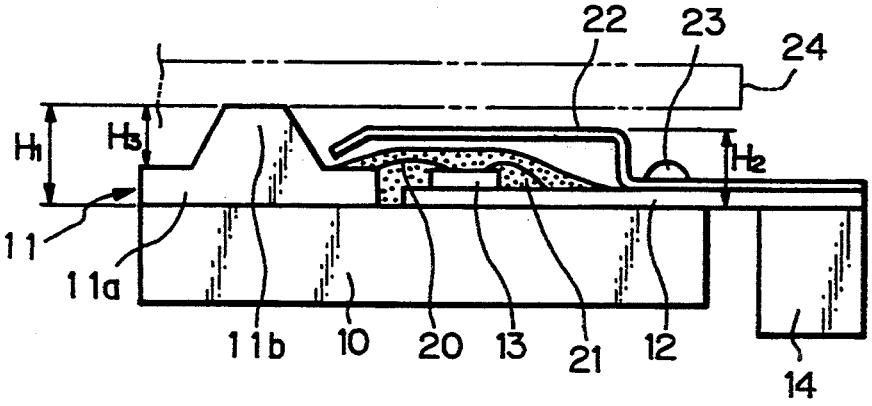
FIG. 1 shows a side view of a preferred embodiment of a thermal head according to the present invention.

Referring to FIG. 1 which shows a preferred embodiment of a thermal head (plane type) according to the present invention, reference numeral 10 denotes a heat sink made of a metal plate such as an aluminum plate, 11 a heating element substrate substantially made of ceramic material such as alumina, and 12 a printed circuit board on which an IC chip 13 is mounted. The substrate 11 and the printed circuit board 12 are fixed on the plane surface of the heat sink 10 by adhesive, or double-sided adhesive tape. The printed circuit board 12 is provided with conductive patterns (not shown) for electrically connecting the IC 13 with an external circuit (not shown) via an connecter 14.

Figure 2:
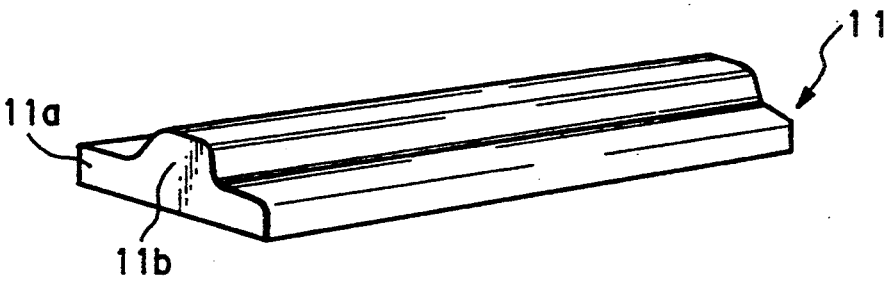
FIG. 2 shows a perspective view of a heating element substrate according to the embodiment shown in FIG. 1.

As seen also in FIG. 2, on a base plate portion 11*a* of the substrate 11, a projected convex portion 11*b* having a trapezoidal section, elongated along the longitudinal direction of the substrate 11 is formed. On the top of the convex portion 11*b*, an array of heating resistor elements (not shown in these figures) are formed by the thin film forming process such as sputtering. In this embodiment, the space between the heating elements will be determined as that 8 to 12 heating elements are arranged per 1 mm width.

Figure 3:
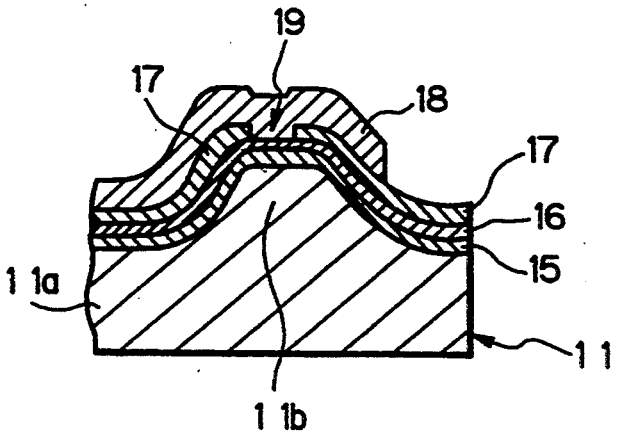
FIG. 3 shows a sectional view of the substrate shown in FIG. 2.

As seen in FIG. 3, the heating elements are formed by successively depositing, on the substrate 11, a glazing layer 15, a heating resistor layer 16, a great number of line leads 17, and a protection layer 18 against wear away of the above-mentioned layers, made of resin for example. A part 19 of the heating resistor layer 16 between the edges of the both sides leads 17 constitutes one of the heating elements.

The leads 17 of the respective heating elements 19 are connected to the IC 13 for driving these heating elements via respective bonding wires 20. As is noted, the electrical connection using wire bonding can simplify the manufacturing process of the thermal head and thus can decrease the manufacturing cost. The drive IC 13 and the bonding wires 20 will be covered by protection resin 21. As for the protection resin 21, soft type resin such as silicon resin which can keep flexibility even after hardened will be used, so as to solve problems which may occur due to a fact that the protection resin will be formed over the substrates having different coefficients of heat expansion. In other words, such the soft type resin will be used in order to prevent unnecessary force from being produced and also to prevent exfoliation of the formed resin, which will be caused by expansion or contraction of the substrates while the resin is hardened.

Over the resin 21, a cover 22 made of a metal plate for example fixed to the heat sink 10 by means of a screw or rivet 23, for securing mechanical protection of the IC 13 is provided.

As shown in FIG. 1, the height $H_1$ of the substrate 11 from the upper surface of the heat sink 10 to the top of the convex portion 11*b* including the formed heating element array is determined to a value higher than that of the height $H_2$ of the cover 22 from the upper surface of the heat sink 10. The height $H_3$ of the convex portion 11b from the upper surface of the base plate portion 11*a* to the top thereof should be determined to a value equal to or more than 0.6 mm, while the thickness of the base plate portion 11*a* will be about 1 to 2 mm.

Since the heating resistor element array is formed on the top of the convex portion 11*b* of the substrate 11 and also the height $H_3$ of the convex portion 11*b* is $H_3 \geqq 0.6$ mm, the height of the heating element array will be certainly higher than the height of a structure, such as the cover 22 in this embodiment, mounted near the heating element array. In another modified embodiment, this structure may be a protection resin (in case of cover less type) or an electronic component such as a connecter. As a result, feeding of a hard sheet 24 to be printed (hard printing media) such as a card (ex. cardboard, plastic card, metal card, etc.) will not be blocked by the structure and printing can be smoothly performed even against the hard sheet 24. A reason why $H_3$ should be as $H_3 \geqq 0.6$ mm will be described in detail later.

Figure 4A:
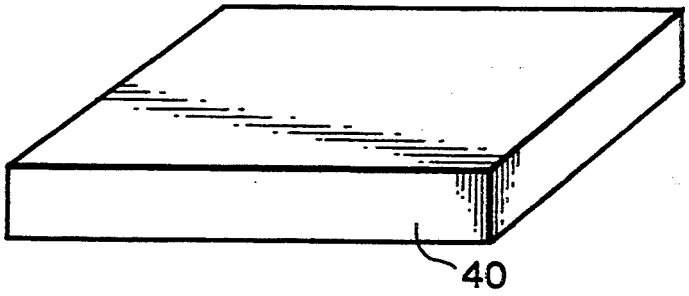
FIGS. 4*a*, 4*b*, and 4*c* show processes of forming the substrate shown in FIG. 2.
Figure 4B:
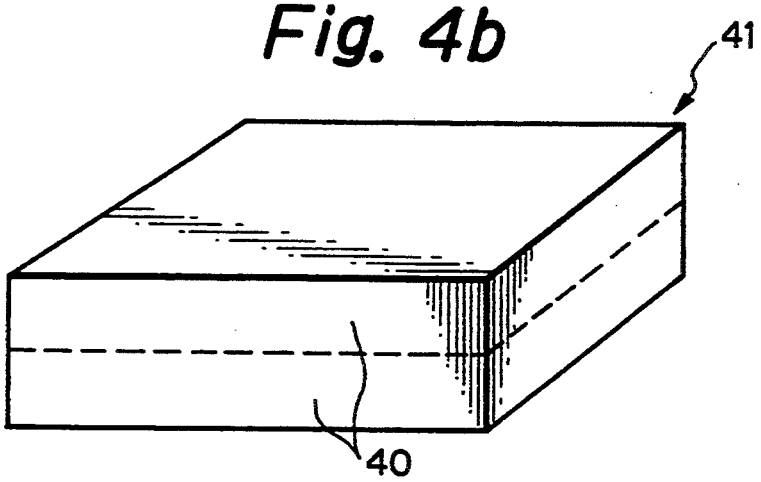
Figure 4C:
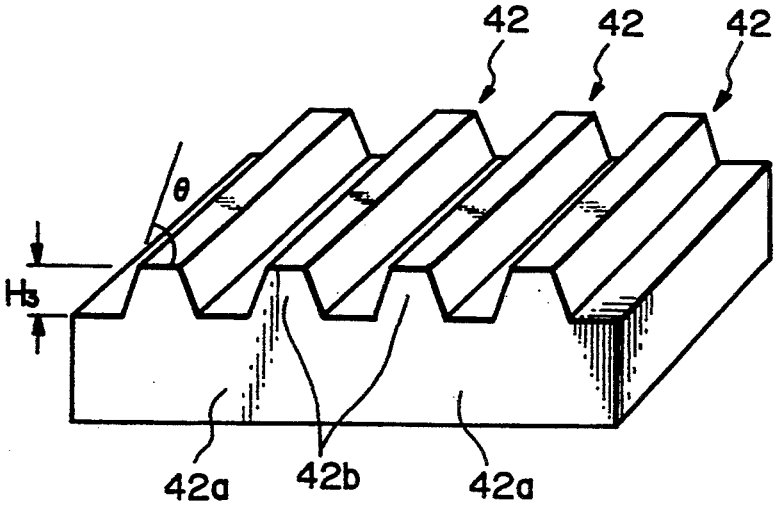

FIGS. 4*a* to 4*c* show processes of forming such the ceramic substrate 11. First, as shown in FIG. 4*a*, a green sheet 40 such as a damp-dry ceramic sheet, with a thickness of about 1 mm, is formed from ceramic powder. Then, two of the green sheets 40 are laminated with each other to form a ceramic plate 41 with a thickness of about 2 mm, as shown in FIG. 4*b*. Thereafter, the ceramic plate 41 is mechanically processed or cut to form a plurality of substrates 42 having respective base plate portions 42*a* and respective mesa-shaped convex portions 42*b*, as shown in FIG. 4*c*. By this cutting, the height $H_3$ of the convex portion 42*b* will be processed to be $H_3 \geqq 0.6$ mm, and an angle (rising angle of the side surface of the convex portion) $\theta$ between the upper surface of the base plate portion 42*a* and at least one side surface of the convex portion 42*a* will be processed to be in a range $20° \leqq \theta \leqq 70°$. Edges of the convex portion 42*b* (11*b*) may be rounded off so that the laminated glazing layer 15 and the photo resist to make the pattern will not be cracked.

Then, the substrates 42 cut as mentioned are burned, and thereafter, the aforementioned glazing layer 15, heating resistor layer 16, line leads 17, and protection layer 18 are successively formed by the thin film forming process. Finally, several separate substrates 11 can be obtained from one block of the substrates by cutting.

If the substrate 11 is burned after the cutting process as mentioned above, the substrate may be contracted resulting an error in size of about 0.2 to 0.8%. In order to solve such problem, namely to form a substrate with precise size, an another forming method in which, at first an alumina plate with a thickness of about 2 mm is burned, and then the mechanical process or cutting process to form a plurality of substrates 42 having respective base plate portions 42*a* and respective mesa-shaped convex portions 42*b*, as shown in FIG. 4*c* will be performed, can be utilized. However, since the alumina substrate is generally too hard to cut after burning, it is not easy to obtain a desired-shaped substrate by this method.

Figure 5:
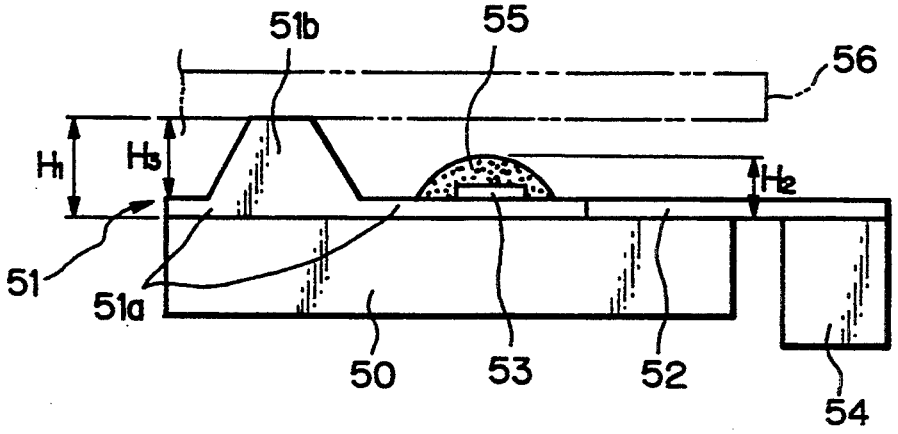
FIG. 5 shows a side view of another embodiment of a thermal head according to the present invention.

FIG. 5 shows an another embodiment of a thermal head (plane type) according to the present invention. In FIG. 5, reference numeral 50 denotes a heat sink made of a metal plate such as an aluminum plate, 51 a heating element substrate substantially made of ceramic material such as alumina, and 52 a printed circuit board. In this embodiment, a flip chip type IC 53 is mounted on a base plate portion 51*a* of the substrate 51. The substrate 51 and the printed circuit board 52 are fixed on the plane surface of the heat sink 50 by adhesive, or double-sided adhesive tape. The substrate 51 and the printed circuit board 52 are provided with conductive patterns (not shown) for electrically connecting the IC 53 with an external circuit (not shown) via an connecter 54.

On the base plate portion 51*a* of the substrate 51, a projected convex portion 51*b* having a trapezoidal section, elongated along the longitudinal direction of the substrate 51 is formed. On the top of the convex portion 51*b*, an array of heating resistor elements (not shown in FIG. 5) are formed by the thin film forming process such as sputtering. In this embodiment, the space between the heating elements will be determined as that 8 to 12 heating elements are arranged per 1 mm width.

Figure 6A:
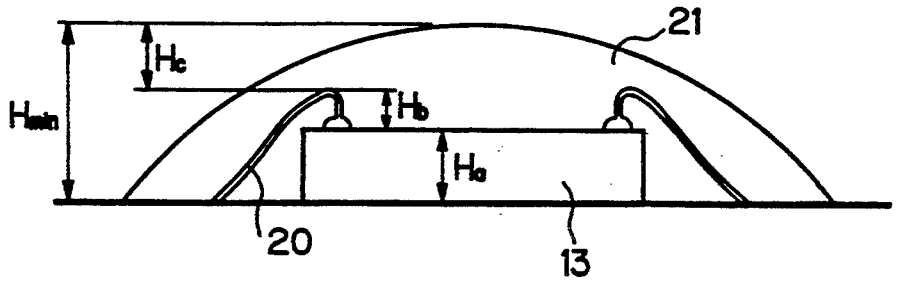
FIGS. 6*a* and 6*b* illustrate mounting height of various IC chips on the substrates.
Figure 6B:
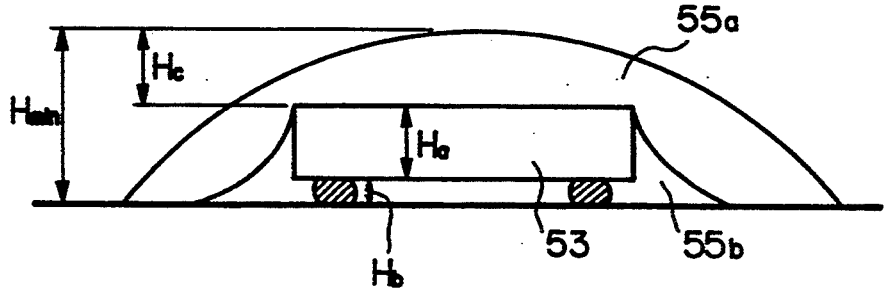

The heating elements are formed on the substrate 51 by the same manner as that in the embodiment of FIG. 1. The heating elements are electrically connected to the IC 53 for driving these heating elements by flip chip bonding via the conductive patterns without using bonding wires. The drive IC 53 will be covered by protection resin 55. As for the protection resin 55, hard type resin such as epoxy resin may be used so that none of cover over the resin 55 is required. In general, this protection resin part is composed of a hard type resin layer 55*a* made of epoxy resin for example and a cushioning layer 55*b* disposed under the layer 55*a* for preventing the layer 55*a* from being cracked, as shown in FIG. 6*b*. The cushioning layer 55*b* may be made of silicone rubber or silicone resin.

The height $H_1$ of the substrate 51 from the upper surface of the heat sink 50 to the top of the convex portion 51*b* including the formed heating element array is determined to a value higher than that of the height $H_2$ of the protection resin 55 from the upper surface of the heat sink 50. The height $H_3$ of the convex portion 51*b* from the upper surface of the base plate portion 51*a* to the top thereof should be determined to a value equal to or more than 0.6 mm.

Since the heating element array is formed on the top of the convex portion 51*b* of the substrate 51 and also the height $H_3$ of the convex portion 51*b* is $H_3 \geqq 0.6$ mm, the height of the heating element array will be certainly higher than the height of a structure, such as the protection resin 55 in this embodiment, mounted near the heating element array. As a result, feeding of a hard sheet to be printed 56 such as a card (ex. cardboard, plastic card, metal card, etc.) will not be blocked by the structure and printing can be smoothly performed against the hard sheet 56.

As similar to the embodiment of FIG. 1, a rising angle $\theta$ of at least one side surface of the convex portion 51*b* will be selected to be in a range $20° \leqq \theta \leqq 70°$.

Hereinafter, a reason why $H_3$ should be as $H_3 \geqq 0.6$ mm is described. FIGS. 6*a* and 6*b* show the height of the protection resin covering the IC chips 13 and 53 of the aforementioned embodiments, respectively.

In case of the wire bonded IC shown in FIG. 6*a*, height or thickness of each part may be:

$H_a$ (IC thickness) . . . about 250 to 500 μm $H_b$ (bonding wire loop height) . . . about 100 to 200 μm $H_c$ (resin thickness above wire) . . . about 250 to 400 μm.

Therefore, the minimum height $H_{min}$ of the protection resin 21 will be about $H_{min}=H_a+H_b+H_c=250$ μm+100 μm+250 μm=600 μm. Since the thickness of the printed circuit board 12 on which the wire bonded IC 13 is disposed will be generally thinner than the thickness of the base plate portion 11*a* of the substrate 11, if $H_3 \geqq 0.6$ mm (600 μm), the height of the heating element array will become higher than the height of the protection resin 21 and also the cover 22.

In case of the flip chip bonded. IC shown in FIG. 6*b*, height or thickness of each part may be:

$H_a$ (XC thickness) . . . about 250 to 500 μm $H_b$ (soldering bump height) . . . about 50 to 60 μm $H_c$ (resin thickness above IC) . . . about 300 to 400 μm.

Therefore, the minimum height $H_{min}$ of the protection resin 55*a* will be about $H_{min}=H_a+H_b+H_c=250$ μm+50 μm+300 μm=600 μm. Therefore, if $H_3 \geqq 0.6$ mm (600 μm), the height of the heating element array will become higher than the height of this protection resin 55*a*.

Figure 7:
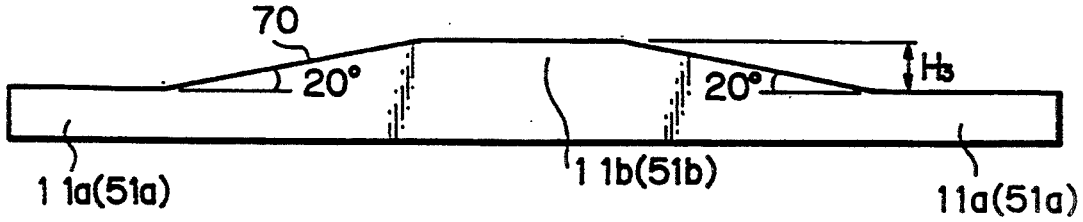
FIG. 7 shows a side view of the substrate with a convex portion, for illustrating a reason why a rising angle of the side surface of the convex portion should be equal to or more than 20 degrees.

Next, a reason why a rising angle θ of the side surface of the convex portion 11*b* (51*b*) of the substrate 11 (51) should be equal to or more than 20 degrees is described. It should be noted that the smaller the rising angle θ of the side surface 70 of the convex portion 11*b* (51*b*), the longer the horizontal width of the side surface 70 causing the size of the substrate 11 (51) to increase. As shown in FIG. 7, if the rising angle θ, the width of the top surface of the convex portion 11*b* (51*b*), and the width of the upper surfaces of the base plate portions 11*a* (51*a*) are determined to 20 degrees, 1 mm, and 1 mm, respectively, total width of the substrate 11 (51) will be about 6 mm. Therefore, if the rising angle θ is set to a value equal to or more than 20 degrees, the width of the substrate 11 (51) will be about 6 mm or less which is smaller in size than a typical substrate having the width of about 10 mm. The smaller the substrate in size, the more substrates being formed from one ceramic sheet resulting effective manufacturing of the head.

Two reasons why the rising angle θ of the side surface of the convex portion 11*b* (51*b*) of the substrate 11 (51) should be equal to or less than 70 degrees are now described.

Figure 8:
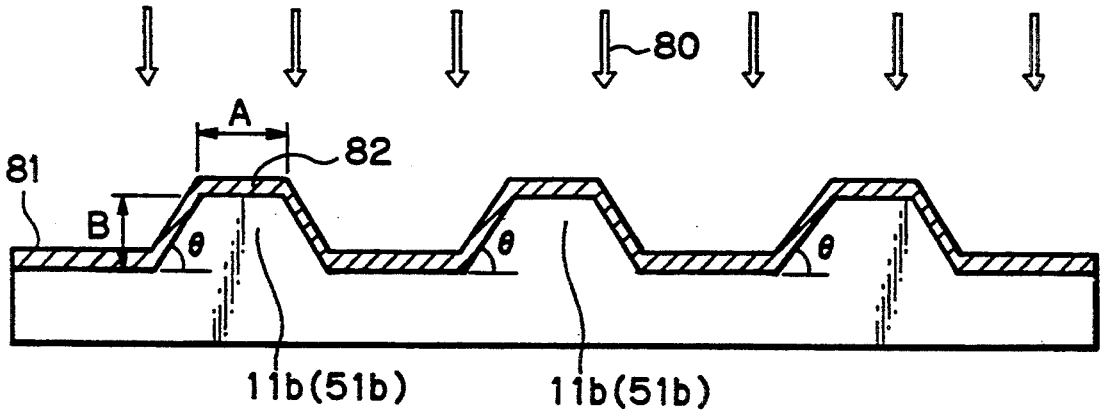
FIG. 8 shows a side view of the substrate with a convex portion, for illustrating a reason why a rising angle of the side surface of the convex portion should be equal to or less than 70 degrees.

One reason concerns about improvement of deposition of the conductive layer on the side surface of the convex portion 11 (51). Namely, if the rising angle θ is close to 90 degrees, it is difficult to deposit sufficient conductive layer on the side surface by sputtering denoted by reference numeral 80. Also, as shown in FIG. 8, if the rising angle θ is above 70 degrees, the deposited conductive layer 81 in a region B on the side surface will be extremely thin in its thickness in comparison with that of the deposited conductive layer 82 in the region A on the top surface of the convex portion 11*b* (51*b*). This causes easy break off of the conductive pattern (line leads) formed on the side surfaces of the convex portion 11*b* (51*b*).

Figure 9:
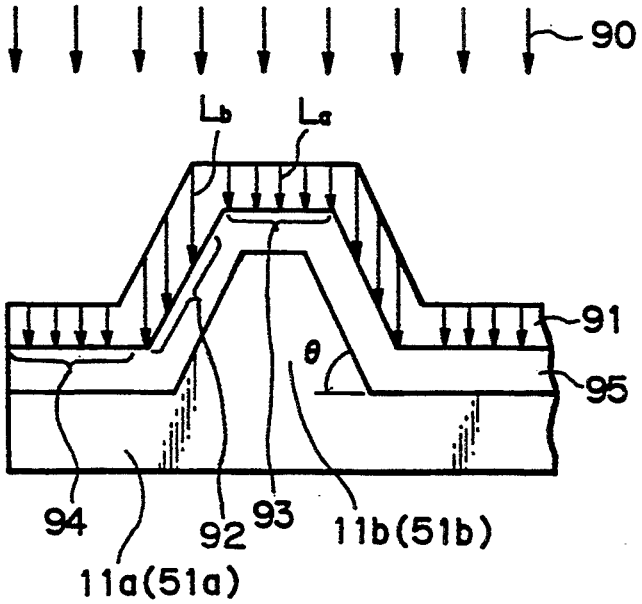
FIG. 9 shows a partial side view of the substrate, for illustrating another reason why the rising angle of the side surface of the convex portion should be equal to or less than 70 degrees.

The other reason concerns about improvement of patterning of the deposited conductive layer. As shown in FIG. 9, if the rising angle θ is above 70 degrees, a path length $L_b$ of the exposing ultra-violet light 90 in a photo resist layer 91 on the side surface region 92 of the convex portion 11*b* (51*b*) greatly differs from a path length $L_a$ of the light 90 in a photo resist layer 91 on the top surface region 93 of the convex portion 11*b* (51*b*) and on the upper surface region 94 of the base plate portion 11*a* (51*a*). Thus, difference of light intensity of the applied ultra-violet light 90 between these regions 92 and 93 (94) becomes too great for performing correct patterning process with respect to the conductive layer 95.

The maximum height of the convex portion 11*b* (51*b*) of the substrate 11 (51) should be about 1.5 mm. This is because if a distance between the photo-mask and the substrate becomes too large during patterning process, interference caused by the exposing ultra-violet light will make it difficult to do precise patterning.

Figure 10:
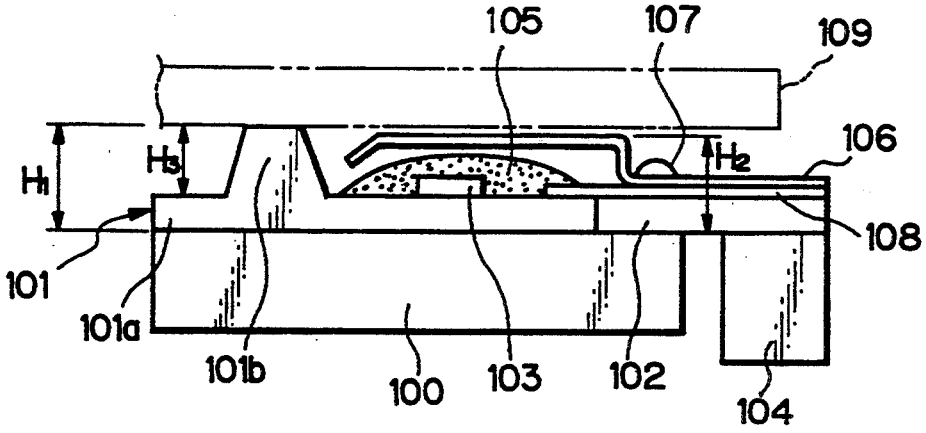
FIG. 10 shows a side view of further embodiment of a thermal head according to the present invention.

FIG. 10 shows a further embodiment of a thermal head (plane type) according to the present invention. In FIG. 10, reference numeral 100 denotes a heat sink made of a metal plate such as an aluminum plate, 101 a heating element substrate substantially made of ceramic material such as alumina, and 102 a board. In this embodiment, a flip chip type IC 103 is mounted on a base plate portion 101*a* of the substrate 101. The substrate 101 and the board 102 are fixed on the plane surface of the heat sink 100 by adhesive, or double-sided adhesive tape. On the board 102 and the substrate 101, a flexible printed circuit board 108 is disposed. The substrate 101 and the flexible printed circuit board 108 are provided with conductive patterns (not shown) for electrically connecting the IC 103 with the heating elements and with an external circuit (not shown) via an connecter 104.

On the base plate portion 101*a* of the substrate 101, a projected convex portion 101*b* having a trapezoidal section, elongated along the longitudinal direction of the substrate 101 is formed. On the top of the convex portion 101*b*, an array of heating resistor elements (not shown in FIG. 10) are formed by the thin film forming process such as sputtering. In this embodiment, the space between the heating elements will be determined as that 8 to 12 heating elements are arranged per 1 mm width.

The heating elements are formed on the substrate 101 by the same manner as that in the embodiment of FIG. 1. The heating elements are electrically connected to the IC 103 for driving these heating elements by flip chip bonding via the conductive patterns without using bonding wires. The drive IC 103 will be covered by protection resin 105. Over the resin 105, a cover 106 made of a metal plate for example fixed to the heat sink 100 by means of a screw or rivet 107, for securing mechanical protection of the IC 103 is provided.

The height $H_1$ of the substrate 101 from the upper surface of the heat sink 100 to the top of the convex portion 101*b* including the formed heating element array is determined to a value higher than that of the height $H_2$ of the cover 106 from the upper surface of the heat sink 100. The height $H_3$ of the convex portion 101*b* from the upper surface of the base plate portion 101*a* to the top thereof should be determined to a value equal to or more than 0.6 mm.

Since the heating element array is formed on the top of the convex portion 101*b* of the substrate 101 and also the height $H_3$ of the convex portion 101*b* is $H_3 \geqq 0.6$ mm, the height of the heating element array will be certainly higher than the height of a structure, such as the cover 106 in this embodiment, mounted near the heating element array. As a result, feeding of a hard sheet to be printed 109 such as a card (ex. cardboard, plastic card, metal card, etc.) will not be blocked by the structure and printing can be smoothly performed against the hard sheet 109.

As similar to the embodiment of FIG. 1, a rising angle $\theta$ of at least one side surface of the convex portion 101*b* will be selected to be in a range $20° \leqq \theta \leqq 70°$.

Figure 11:
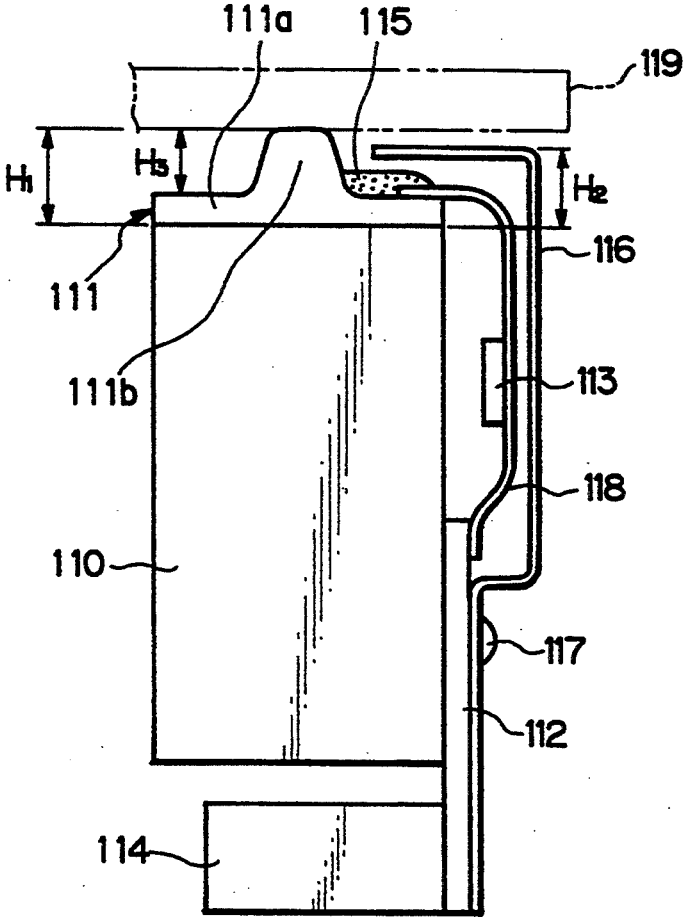
FIG. 11 shows a side view of still further embodiment of a thermal head according to the present invention.

FIG. 11 shows a still further embodiment of a thermal head (end face type) according to the present invention. In FIG. 11, reference numeral 110 denotes a heat sink made of a metal block such as an aluminum block, and 111 a heating element substrate substantially made of ceramic material such as alumina which is fixed on the end surface of the heat sink 110 by adhesive, or double-sided adhesive tape. A hard printed circuit board 112 is fixed on the plane surface of the heat sink 110 by adhesive, or double-sided adhesive tape. In this embodiment, an IC 113 with gold bumps is mounted on a film carrier (TAB tape) 118 disposed on the plane surface side of the heat sink 110. The substrate 111, the printed circuit board 112, and the film carrier 118 are provided with conductive patterns (not shown) for electrically connecting the IC 113 with the heating elements and with an external circuit (not shown) via an connecter 114.

On the base plate portion 111*a* of the substrate 111, a projected convex portion 111*b* having a trapezoidal section, elongated along the longitudinal direction of the substrate 111 is formed. On the top of the convex portion 111*b*, an array of heating resistor elements are formed by the thin film forming process such as sputtering. In this embodiment, the space between the heating elements is determined as that 8 heating elements are arranged per 1 mm width.

The heating elements are formed on the substrate 111 by the same manner as that in the embodiment of FIG. 1. The heating elements are electrically connected to the IC 113 for driving these heating elements by out lead bonding with the film carrier via the conductive patterns without using wire bonding. The joint portion between the conductive patterns on the base plate surface of the substrate 111 and the film carrier 118 will be covered by protection resin 115. Over the resin 115 and the film carrier 118, a cover 116 made of a metal plate for example fixed to the heat sink 110 by means of a screw or rivet 117, for mechanically protecting the joint portion and the IC 113 is provided.

The height $H_1$ of the substrate 101 from the end surface of the heat sink 110 to the top of the convex portion 111*b* including the formed heating element array is determined to a value higher than that of the height $H_2$ of the cover 116 from the end surface of the heat sink 110. The height $H_3$ of the convex portion 111*b* from the upper surface of the base plate portion 111*a* to the top thereof should be determined to a value equal to or more than 0.6 mm.

Since the heating element array is formed on the top of the convex portion 111*b* of the substrate 111 and also the height $H_3$ of the convex portion 111*b* is $H_3 \geqq 0.6$ mm, the height of the heating element array will be certainly higher than the height of a structure, such as the cover 116 in this embodiment, mounted near the heating element array. As a result, feeding of a hard sheet to be printed 119 such as a card (ex. cardboard, plastic card, metal card, etc.) will not be blocked by the structure and printing can be smoothly performed against the hard sheet 119.

This embodiment has advantages of both the plane face type and end face type thermal heads. Namely, since all the bottom surface of the substrate 111 contacts with the end surface of the heat sink 110 and thus heat conduction path is very short, heat from the heating elements will be easily transmitted to the heat sink 110. Thus, effective radiation of heat and therefore good printing without blot can be expected as well as the plane face type thermal head. The size of the end surface of the thermal head, used for printing can be designed in small causing the total size of the printer to be small, as well as the end face thermal head.

As similar to the embodiment of FIG. 1, since the substrate 111 of this embodiment can be formed small in size, effective manufacturing of the head can be also obtained. It is another advantages of this embodiment that the substrate of this end face type thermal head can be manufactured by the same manufacturing line as that of the plane type thermal head.

Also as similar to the embodiment of FIG. 1, a rising angle $\theta$ of at least one side surface of the convex portion 111*b* will be selected to be in a range $20° \leqq \theta \leqq 70°$.

Figure 12:
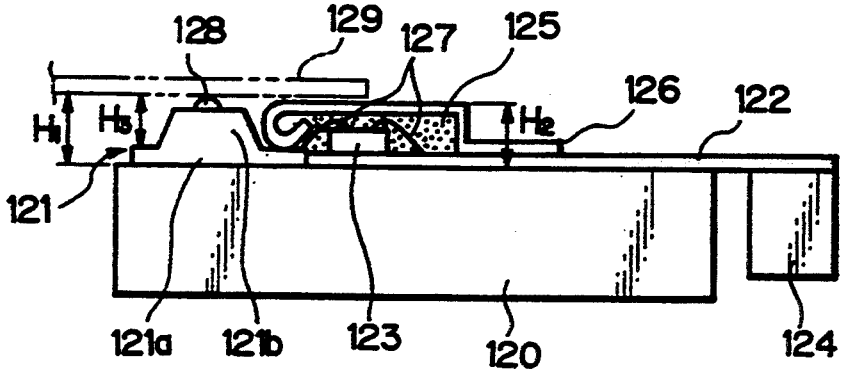
FIG. 12 shows a side view of further embodiment of a thermal head according to the present invention.

FIG. 12 shows a further embodiment of a thermal head (plane type) according to the present invention in FIG. 12, reference numeral 120 denotes a heat sink made of a metal plate such as an aluminum plate, 121 a heating element substrate substantially made of ceramic material such as alumina, and 122 a printed circuit board on which an IC chip 123 is mounted. The substrate 121 and the printed circuit board 122 are fixed on the plane surface of the heat sink 120 by adhesive, or double-sided adhesive tape. The printed circuit board 122 is provided with conductive patterns (not shown) for electrically connecting the IC 123 with an external circuit (not shown) via an connecter 124.

As seen also in FIG. 12, on a base plate portion 121*a* of the substrate 121, a projected convex portion 121*b* having a trapezoidal section, elongated along the longitudinal direction of the substrate 121 is formed. On the top of the convex portion 121*b*, a projected array 128 of heating resistor elements are formed by the thin film forming process such as sputtering. In this embodiment, the space between the heating elements will be determined as that 8 to 12 heating elements are arranged per 1 mm width.

The heating elements 128 and many line leads (not shown) connected to the respective heating element are formed on the substrate 121. These leads are connected to the IC 123 for driving the heating elements 128 via respective bonding wires 127. The drive IC 123 and the bonding wires 127 will be covered by protection resin 125. As for the protection resin 125, soft type resin such as silicon resin which can keep flexibility even after hardened will be used, so as to solve problems which may occur due to a fact that the protection resin will be formed over the substrates having different coefficients of heat expansion, as mentioned in the embodiment of FIG. 1.

A cover 126 made of a metal plate for example for mechanically protecting the IC 123 and the bonding wires 127 is closely contacted with the resin 125 before this resin is hardened so that the cover 126 is fixed to the printed circuit board 122 by means of the resin 125. One end (free end) of the cover 126 is abutted to the substrate 121 so that precise adjustment of the height of the cover 126 itself can be easier.

Since the cover 126 is adhered closely to the resin 125 and thus the height of the resin 125 is adjusted by the shape of the cover 126, the height $H_2$ of the cover 126 and also the resin 125 can be kept low.

As shown in FIG. 12, the height $H_1$ of the substrate 121 from the upper surface of the heat sink 120 to the top of the convex portion 121*b* including the formed heating element array 128 is determined to a value higher than that of the height $H_2$ of the cover 126 from the upper surface of the heat sink 120. The height $H_3$ of the convex portion 121*b* from the upper surface of the base plate portion 121*a* to the top thereof should be determined to a value equal to or more than 0.6 mm.

Since the heating element array 128 is formed on the top of the convex portion 121*b* of the substrate 121 and also the height $H_3$ of the convex portion 121*b* is $H_3 \geqq 0.6$ mm, the height of the heating element array 128 will be certainly higher than the height of a structure, such as the cover 126 in this embodiment, mounted near the heating element array 128.

As a result, feeding of a hard sheet to be printed 129 such as a card (ex. cardboard, plastic card, metal card, etc.) will not be blocked by the structure and printing can be smoothly performed against the hard sheet 129. Furthermore, even if this thermal head is used for printing against ordinal flexible paper, the cover 126 can be positioned near the heating element array 128 so that a platen roller (not shown) for pressing the paper to the heating element array 128 does not touch the cover. This causes the substrate 121 to become small in size. If the size of the head substrate 121 is small, a great number of the substrates 121 can be processed in one sputtering process for forming a thin-film layer on the substrate 121, causing the manufacturing cost of each thermal head to decrease. Otherwise, since the diameter of the platen roller can be freely designed as for example to be larger without increasing the thermal head size, design of the printer using this thermal head will be easier.

Also, according to this embodiment, because the cover 126 is fixed to the board 122 by using the resin 125 as adhesive, no special parts such as screws for fixing the cover 126 are necessary. Therefore, a process of fixing cover 126 can be eliminated causing the manufacturing cost of the thermal head to decrease.

As similar to the embodiment of FIG. 1, a rising angle $\theta$ of at least one side surface of the convex portion 121*b* will be selected to be in a range $20° \leqq \theta \leqq 70°$.

Figure 13:
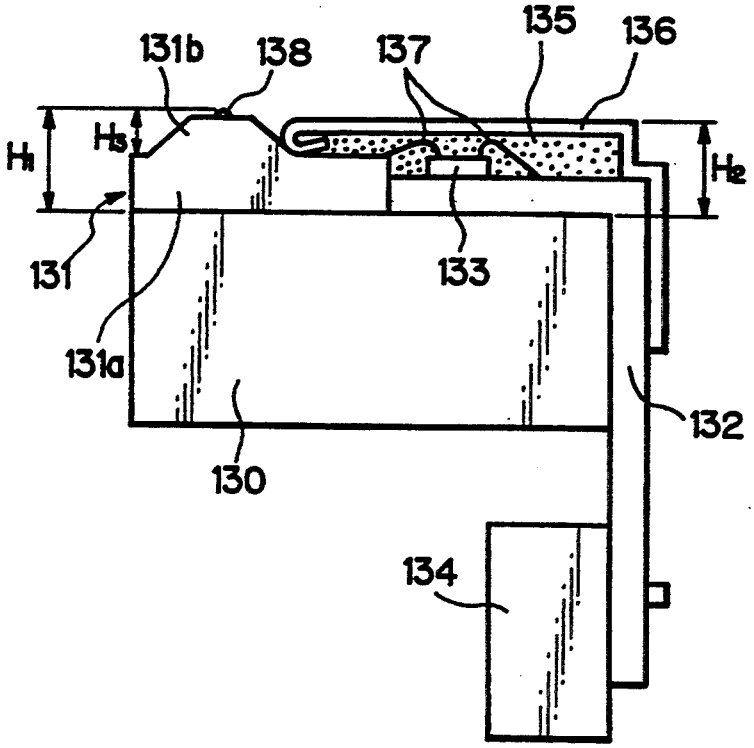
FIG. 13 shows a side view of further embodiment of a thermal head according to the present invention.
Figure 14:
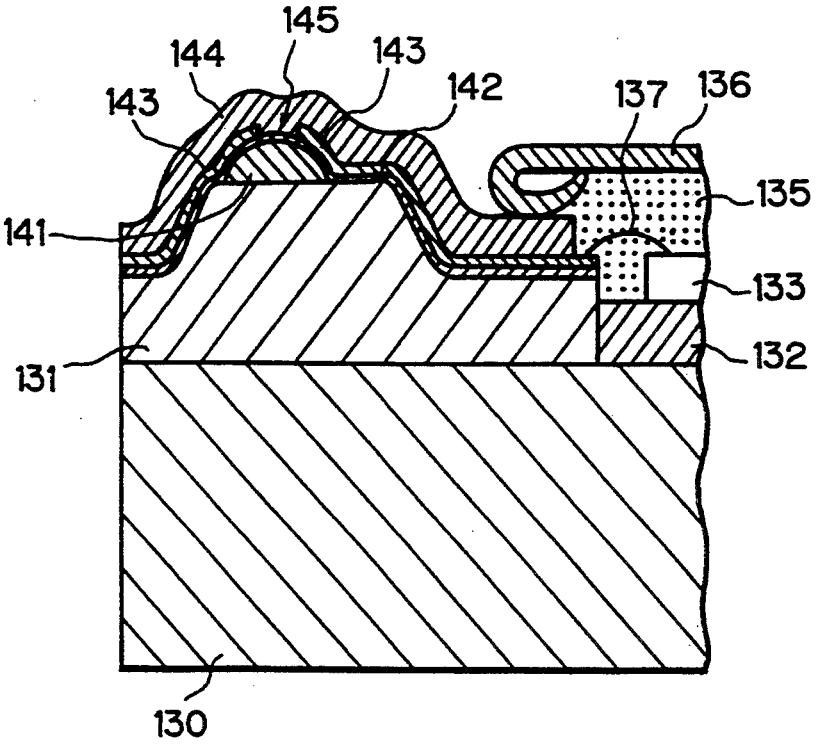
FIG. 14 shows a sectionally partial view of the thermal head shown in FIG. 13.

FIG. 13 shows a still further embodiment of a thermal head according to the present invention, and FIG. 14 shows a sectionally partial view of the thermal head shown in FIG. 13. In FIGS. 13 and 14, reference numeral 130 denotes a heat sink made of a metal block such as an aluminum block, and 131 a heating element substrate substantially made of ceramic material such as alumina which is fixed on the upper surface of the heat sink 130 by adhesive, or double-sided adhesive tape. A flexible printed circuit board 132 is disposed along and fixed to the upper surface of the heat sink 130, is bent in the middle thereof, and is disposed along and fixed to the side surface of the heat sink 130 by adhesive, double-sided adhesive tape, or screw. In this embodiment, an IC 133 is mounted on a part of the flexible printed circuit board 132 disposed on the upper surface of the heat sink 130. Namely, the IC 133 is positioned on the same side as that of the heating element substrate 131. The substrate 131 and the printed circuit board 132 are provided with conductive patterns (not shown) for electrically connecting the IC 133 with the heating elements and with an external circuit (not shown) via an connecter 134.

On the base plate portion 131*a* having a thickness of about 1 mm for example of the substrate 131, a projected convex portion 131*b* having a trapezoidal section, elongated along the longitudinal direction of the substrate 131 is formed. The height of the convex portion 131*b* may be about 1 mm for example. On the top of the convex portion 131*b*, a projected array 138 of heating resistor elements are formed by the thin film forming process such as sputtering. In this embodiment, the space between the heating elements is determined as that 8 to 12 heating elements are arranged per 1 mm width.

As shown in FIG. 14, the heating elements are formed by successively depositing, on the substrate 131, a projected glazing layer 141 in the shape of a half column having a thickness of about 60 μm, a heating resistor layer 142 having a thickness of about 1000 to 2000 Å, a great number of line leads 143 having a thickness of less than 1 μm, preferably 5000 to 7000 Å, and a protection layer 144 made of resin for example having a thickness of about 5 to 10 μm. A part 145 of the heating resistor layer 142 between the edges of the both sides leads 143 (distance of which is about 110 to 180 μm for example) constitutes one of the heating elements.

The leads 143 of the heating elements 145 are connected to the IC 133 for driving these heating elements via respective bonding wires 137. The drive IC 133 and the bonding wires 137 will be covered by protection resin 135. As for the protection resin 135, soft type resin such as silicon resin which can keep flexibility even after hardened will be used, so as to solve problems which may occur due to a fact that the protection resin will be formed over the substrates having different coefficients of heat expansion, as mentioned in the embodiment of FIG. 1.

A cover 136 made of a metal plate for example for mechanically protecting the IC 133 and the bonding wires 137 is closely contacted with the resin 135 before this resin is hardened so that the cover 136 is fixed to the printed circuit board 132 by means of the resin 135. One end (free end) of the cover 136 is folded so that adjustment of the height of the cover 136 itself can be easier.

Since the cover 136 is adhered closely to tile resin 135 and thus the height of the resin 135 is adjusted by the shape of the cover 136, the height $H_2$ of the cover 136 and also the resin 135 can be kept low.

The height $H_1$ of the substrate 131 from the end surface of the heat sink 130 to the top of the convex portion 131*b* including the formed heating element array is determined to a value higher than that of the height $H_2$ of the cover 136 from the end surface of the heat sink 130. The height $H_3$ of the convex portion 131*b* from the upper surface of the base plate portion 131*a* to the top thereof should be determined to a value equal to or more than 0.6 mm.

Since the heating element array is formed on the top of the convex portion 131*b* of the substrate 131 and also the height $H_3$ of the convex portion 131*b* is $H_3 \geqq 0.6$ mm, the height of the heating element array 138 will be higher than the height of a structure, such as the cover 136 in this embodiment, mounted near the heating element array. As a result, feeding of a hard sheet to be printed (not shown) such as a card (ex. cardboard, plastic card, metal card, etc.) will not be blocked by the structure and printing can be smoothly performed against the hard sheet.

This embodiment has advantages of both the plane face type and end face type thermal heads. Namely, since all the bottom surface of the substrate 131 contacts with the upper surface of the heat sink 130 and thus heat conduction path is very short, heat from the heating elements will be easily transmitted to the heat sink 130. Thus, effective radiation of heat and therefore good printing without blot can be expected as well as the plane type thermal head. Also, since only the heating element substrate 131 and a part of the printed circuit board 132 are mounted on the upper surface of the heat sink 130 and the remained part of the printed circuit board 132 is disposed on the side surface of the heat sink 130, the size of the upper surface used for printing can be designed in small causing the total size of the printer to be small, as well as the end face thermal head.

Furthermore, as similar to the embodiment of FIG. 1, since the substrate 131 of this embodiment can be formed small in size, effective manufacturing of the head can be also obtained. It is another advantages of this embodiment that the substrate of this end face type thermal head can be manufactured by the same manufacturing line as that of the plane type thermal head.

Also as similar to the embodiment of FIG. 1, a rising angle $\theta$ of at least one side surface of the convex portion 131*b* will be selected to be in a range $20° \leqq \theta \leqq 70°$.

Figure 15:
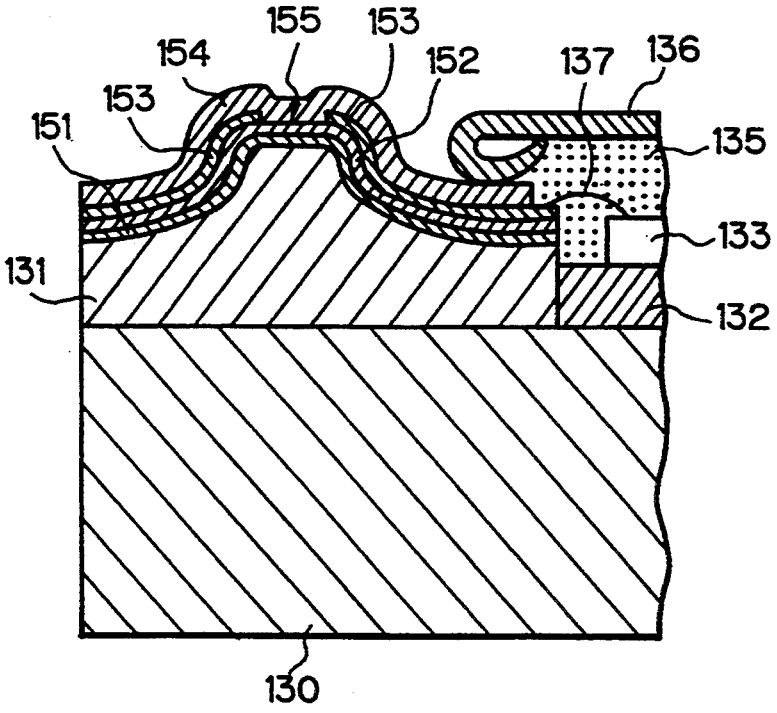
FIG. 15 shows a sectionally partial view of a modified thermal head.

In another embodiment shown in FIG. 15, the glazing layer on the heating element substrate 131 may be formed as a layer 151 having a uniform thickness. In FIG. 15, on the substrate 131, the uniform thickness glazing layer 151, a heating resistor layer 152, a great number of line leads 153, and a protection layer 154 are successively deposited. A part 155 of the heating resistor layer 152 between the edges of the both sides leads 153 constitutes one of the heating elements.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thermal head for thermal transfer recording, comprising:

a heat sink means having an upper surface;

a heating element substrate, disposed on said upper surface of said heat sink means, having a projected convex portion on which an array of heating resistor elements are arranged;

an electrical structure electrically connected to said heating resistor elements;

an electrical connection substrate, disposed over the upper surface of said heat sink means, for electrically connecting said electrical structure with an external circuit, said electrical structure being mounted on said electrical connection substrate and;

protection means over said electrical structure for mechanically protecting said electrical structure, and wherein said heating element substrate is constituted such that the height of said heating element substrate from the upper surface of said heat sink means is higher than the heights of said electrical structure and said protection means, and such that the height of said projected convex portion is equal to or more than 0.6 mm.

2. A thermal head as claimed in claim 1, wherein said projected convex portion has at least one elongated side surface, and wherein said heating element substrate is constituted such that a raising angle of said at least one elongated side surface is equal to or more than 20 degrees.

3. A thermal head as claimed in claim 2, wherein said heating element substrate is constituted such that a raising angle of said at least one elongated side surface is equal to or less than 70 degrees.

4. A thermal head as claimed in claim 1, wherein said electrical structure includes an IC for driving said heating resistor elements and bonding wires for electrically connecting said IC to said heating resistor elements and to said electrical connection substrate.

5. A thermal head as claimed in claim 1, wherein said protection means includes a protection resin for covering said electrical structure and a cover disposed over said protection resin.

6. A thermal head as claimed in claim 1, wherein said protection means includes a protection resin for covering said electrical structure and a cover disposed on and integrated with said protection resin, said cover being fixed to said electrical connection substrate by said protection resin.

7. A thermal head as claimed in claim 6, wherein one end of said cover is abutted to said heating element substrate.

8. A thermal head for thermal transfer recording, comprising:

a heat sink means having an upper surface;

a heating element substrate, disposed on said upper surface of said heat sink means, having a projected convex portion on which an array of heating resistor elements are arranged;

an electrical structure electrically connected to said heating resistor elements;

an electrical connection substrate, disposed over the upper surface of said heat sink means, for electrically connecting said electrical structure with an external circuit, said electrical structure being mounted on said heating element substrate; and a protection means over said electrical structure for mechanically protecting said electrical structure, and wherein said electrical connection substrate is constituted such that the height of said electrical connection substrate from the upper surface of said heat sink means is higher than the heights of said electrical structure and said protection means, and such that the height of said projected convex portion is equal to or more than 0.6 mm.

9. A thermal head as claimed in claim 8, wherein said projected convex portion has at least one elongated side surface, and wherein said heating element substrate is constituted such that a raising angle of said at least one elongated side surface is equal to or more than 20 degrees.

10. A thermal head as claimed in claim 9, wherein said heating element substrate is constituted such that a raising angle of said at least one elongated side surface is equal to or less than 70 degrees.

11. A thermal head as claimed in claim 8, wherein said electrical structure includes an IC for driving said heating resistor elements, said IC being electrically connected to said heating resistor elements and to said electrical connection substrate by a flip chip bonding or a wire bonding.

12. A thermal head as claimed in claim 8, wherein said protection means consists of a hard type protection resin for covering said electrical structure.

13. A thermal head as claimed in claim 8, wherein said protection means consists of a hard type protection resin for covering said electrical structure and a cushioning layer for preventing said hard type protection resin from being cracked.

14. A thermal head as claimed in claim 8, wherein said protection means includes a protection resin for covering said electrical structure and a cover disposed over said protection resin.

15. A thermal head for thermal recording or thermal transfer recording comprising:

a heat sink means having an upper surface and a side surface;

a heating element substrate, disposed on said upper surface of said heat sink means, having a projected convex portion on which an array of heating resistor elements are arranged;

a circuit board disposed on said side surface, and coupled with an external circuit;

a film carrier, one end of which is coupled with the heating element substrate, and the other end of which is coupled with said circuit board;

an electrical structure also coupled with said film carrier; and a protection means for mechanically protecting said electrical structure.

16. The thermal head as defined by claim 15, wherein said heating element substrate is constituted such that the height of said heating element substrate from said upper surface of said heat sink means is equal to or more than 0.6 mm.

17. A thermal head as claimed in claim 15, wherein said projected convex portion has at least one elongated side surface, and wherein said heating element substrate is constituted such that a raising angle of said at least one elongated side surface is equal to or more than 20 degrees.

18. A thermal head as claimed in claim 17, wherein said heating element substrate is constituted such that a raising angle of said at least one elongated side surface is equal to or less than 70 degrees.

19. A thermal head as claimed in claim 15, wherein said electrical structure comprises an electrical junction of said heating resistor elements and said film carrier.

20. A thermal head as claimed in claim 19, wherein said head further comprises an IC for driving said heating resistor elements, said IC being mounted on said film carrier.

21. A thermal head as claimed in claim 19, wherein said protection means includes a protection resin for covering said electrical junction and a cover disposed over said protection resin.

22. A thermal head for thermal transfer recording, comprising:

a heat sink means having an upper surface and a side surface;

a heating element substrate, disposed on said upper surface of said heat sink means, having a projected convex portion on which an array of heating resistor elements are arranged;

an electrical structure electrically connected to said heating resistor elements; and a flexible electrical connection substrate, one end of which is disposed on said upper surface of said heat sink means and the other end of which is disposed on said side surface of said heat sink means, for electrically connecting said electrical structure with an external circuit, said electrical structure being mounted on said flexible electrical connection substrate.

23. A thermal head as claimed in claim 22, further comprising a protection means over said electrical structure for mechanically protecting said electrical structure, and wherein said heating element substrate is constituted such that the height of said heating element substrate from the upper surface of said heat sink means is higher than the heights of said electrical structure and said protection means, and such that the height of said projected convex portion is equal to or more than 0.6 mm.

24. A thermal head as claimed in claim 23, wherein said projected convex portion has at least one elongated side surface, and wherein said heating element substrate is constituted such that a raising angle of said at least one elongated side surface is equal to or more than 20 degrees.

25. A thermal head as claimed in claim 24, wherein said heating element substrate is constituted such that a raising angle of said at least one elongated side surface is equal to or less than 70 degrees.

26. A thermal head as claimed in claim 23, wherein said protection means includes a protection resin for covering said electrical structure and a cover disposed over said protection resin.

27. A thermal head as claimed in claim 23, wherein said protection means includes a protection resin for covering said electrical structure and a cover disposed on and integrated with said protection resin, said cover being fixed to said flexible electrical connection substrate by said protection resin.

28. A thermal head as claimed in claim 23, wherein one end of said cover is abutted to said heating element substrate.

29. A thermal head as claimed in claim 23, wherein said electrical structure includes an IC for driving said heating resistor elements, said IC being electrically connected to said heating resistor elements and to said flexible electrical connection substrate by flip chip bonding.

30. A method of manufacturing a thermal head, comprising the steps of:

forming a heating element substrate having a projected convex portion on which an array of heating resistor elements are arranged;

mounting said heating element substrate on an upper surface of a heat sink;

mounting an electrical structure over said upper surface of said heat sink and electrically connecting the electrical structure to said heating resistor elements; and forming a protection means over said electrical structure for mechanically protecting said electrical structure so that the height of said heating element substrate from the upper surface of said heat sink is higher than the height of said protection means, and so that the height of said projected convex portion is equal to or more than 0.6 mm.

31. A method as claimed in claim 30, wherein said heating element substrate forming step comprises a step of forming the heating element substrate so that said projected convex portion has at least one elongated side surface, and so that a raising angle of said at least one elongated side surface is equal to or more than 20 degrees.

32. A method as claimed in claim 31, wherein said raising angle of said side surface is equal to, or less than 70 degrees.

33. A method as claimed in claim 30, wherein said heating element substrate forming step comprises a step of forming the heating element substrate so that said projected convex portion has at least one elongated side surface, and so that a raising angle of said at least one elongated side surface is equal to or less than 70 degrees.

34. A method as claimed in claim 30, wherein said heating element substrate forming step comprises steps of mechanically cutting a basic plate block to form a plurality of heating element substrates on the block and then burning the cut block.

35. A method as claimed in claim 34, wherein said heating element substrate forming step further comprises a step of forming a plurality of layers on the burned block by thin film forming processes.

36. A method as claimed in claim 35, wherein said heating element substrate forming step further comprises a step of separating the block which has been subjected to the thin film forming process into a plurality of heating element substrates.

37. A method as claimed in claim 30, wherein said method further comprises steps of mounting an IC for driving said heating resistor elements on an electrical connection substrate by flip chip bonding, mounting said electrical connection substrate on said upper surface of said heat sink, and electrically connecting said IC with an external circuit.

38. A method as claimed in claim 37, wherein said protection means forming step comprises steps of forming a protection resin for covering said IC, and attaching a cover on said resin before said resin is hardened so that said cover is integral with said resin and fixed to said electrical connection substrate by said resin.

* * * * *